US011525566B1

(12) United States Patent
Shiraishi

(10) Patent No.: US 11,525,566 B1
(45) Date of Patent: Dec. 13, 2022

(54) VEHICLE LUMINAIRE AND VEHICLE LAMP

(71) Applicant: Toshiba Lighting & Technology Corporation, Yokosuka (JP)

(72) Inventor: Hiromitsu Shiraishi, Ehime-ken (JP)

(73) Assignee: Toshiba Lighting & Technology Corporation, Yokosuka (JP)

( * ) Notice: Subject to any disclaimer, the term of this patent is extended or adjusted under 35 U.S.C. 154(b) by 0 days.

(21) Appl. No.: 17/665,007

(22) Filed: Feb. 4, 2022

(30) Foreign Application Priority Data

May 25, 2021 (JP) ..... JP2021-087401

(51) Int. Cl.
*F21V 23/06* (2006.01)
*F21S 41/32* (2018.01)
*F21S 41/143* (2018.01)

(52) U.S. Cl.
CPC ..... *F21V 23/06* (2013.01); *F21S 41/143* (2018.01); *F21S 41/321* (2018.01)

(58) Field of Classification Search
CPC ..... F21V 23/06; F21S 41/143; F21S 41/321
See application file for complete search history.

(56) References Cited

U.S. PATENT DOCUMENTS

2016/0290587 A1 10/2016 Nakagawa et al.
2018/0073714 A1* 3/2018 Ozawa ..... F21S 43/14
2019/0267355 A1* 8/2019 Ueno ..... F21S 41/192
2019/0383463 A1* 12/2019 Kosugi ..... F21S 43/14
2020/0355342 A1 11/2020 Hatanaka et al.

FOREIGN PATENT DOCUMENTS

EP 3279552 A1 2/2018
EP 3285002 A1 * 2/2018 ..... F21S 43/14
JP 2016-195099 A 11/2016

* cited by examiner

*Primary Examiner* — Evan P Dzierzynski
(74) *Attorney, Agent, or Firm* — Banner & Witcoff, Ltd.

(57) ABSTRACT

A vehicle luminaire according to an embodiment includes: a socket including a mounting portion and a plurality of bayonets provided on an outer surface of the mounting portion; and a light-emitting module provided inside a first recess of the mounting portion which opens on one end of the mounting portion. The light-emitting module includes a board, a wiring pattern provided on a surface of the board, and a light-emitting element electrically connected to the wiring pattern. The mounting portion includes at least one second recess that opens on a bottom surface of the first recess. When viewed from a direction along a central axis of the vehicle luminaire, the second recess is provided between a side of the board and an inner wall of the first recess that faces the side.

20 Claims, 3 Drawing Sheets

VEHICLE LUMINAIRE AND VEHICLE LAMP

CROSS-REFERENCE TO RELATED APPLICATIONS

This application is based upon and claims the benefit of priority from Japanese Patent Application No. 2021-087401, filed on May 25, 2021; the entire contents of which are incorporated herein by reference.

FIELD

Embodiments described herein relate generally to a vehicle luminaire and a vehicle lamp.

BACKGROUND

From viewpoints of energy saving and elongation of a service life, a vehicle luminaire including a light-emitting diode is becoming increasingly common in place of a vehicle luminaire including a filament. The vehicle luminaire may be provided outside a vehicle interior. The vehicle luminaire provided outside the vehicle interior is required to have high reliability so as to be able to withstand a severe use environment such as a high temperature, a low temperature, high humidity, vibration, and an impact.

Here, for example, a temperature of the vehicle luminaire changes as the vehicle luminaire is turned on and off. The temperature of the vehicle luminaire may change due to a change in a temperature of an environment. When the vehicle luminaire is placed in a humid environment and the temperature of the vehicle luminaire changes, water may adhere to the vehicle luminaire due to dew condensation. If the water adheres to the vehicle luminaire, for example, a short circuit or ion migration may occur in a wiring pattern to which the light-emitting diode is connected.

Therefore, it was desired to develop a technique capable of reducing an occurrence of functional impairment caused by the dew condensation even when the vehicle luminaire is placed in the humid environment.

DETAILED DESCRIPTION

Figure 1:
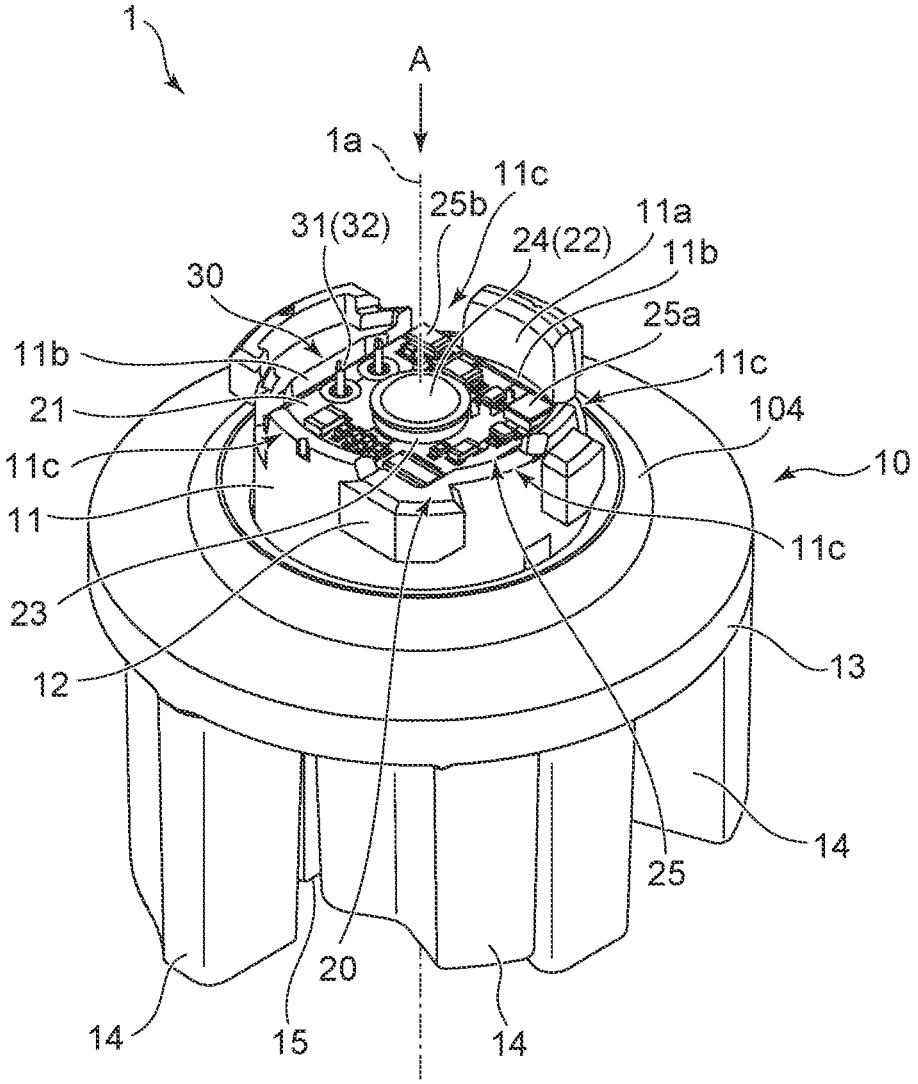
FIG. 1 is a schematic perspective view illustrating a vehicle luminaire according to the present embodiment.

In general, according to one embodiment, a vehicle luminaire includes: a socket including a mounting portion and a plurality of bayonets provided on an outer surface of the mounting portion; and a light-emitting module provided inside a first recess of the mounting portion which opens on one end of the mounting portion. The light-emitting module includes a board, a wiring pattern provided on a surface of the board, and a light-emitting element electrically connected to the wiring pattern. The mounting portion includes at least one second recess that opens on a bottom surface of the first recess. When viewed from a direction along a central axis of the vehicle luminaire, the second recess is provided between a side of the board and an inner wall of the first recess that faces the side.

Hereinafter, an embodiment is described with reference to the drawings. In the drawings, the same components are denoted by the same reference numerals, and a detailed description thereof will be omitted as appropriate.

Vehicle Luminaire

A vehicle luminaire 1 according to the present embodiment can be provided in, for example, an automobile or a railroad vehicle. Examples of the vehicle luminaire 1 provided in the automobile include those used for a front combination light (for example, an appropriate combination of a daytime running lamp (DRL), a position lamp, a turn signal lamp, and the like), a rear combination light (for example, an appropriate combination of a stop lamp, a tail lamp, a turn signal lamp, a back lamp, a fog lamp, and the like), and the like. However, a use of the vehicle luminaire 1 is not limited thereto.

FIG. 1 is a schematic perspective view illustrating the vehicle luminaire 1 according to the present embodiment.

Figure 2:
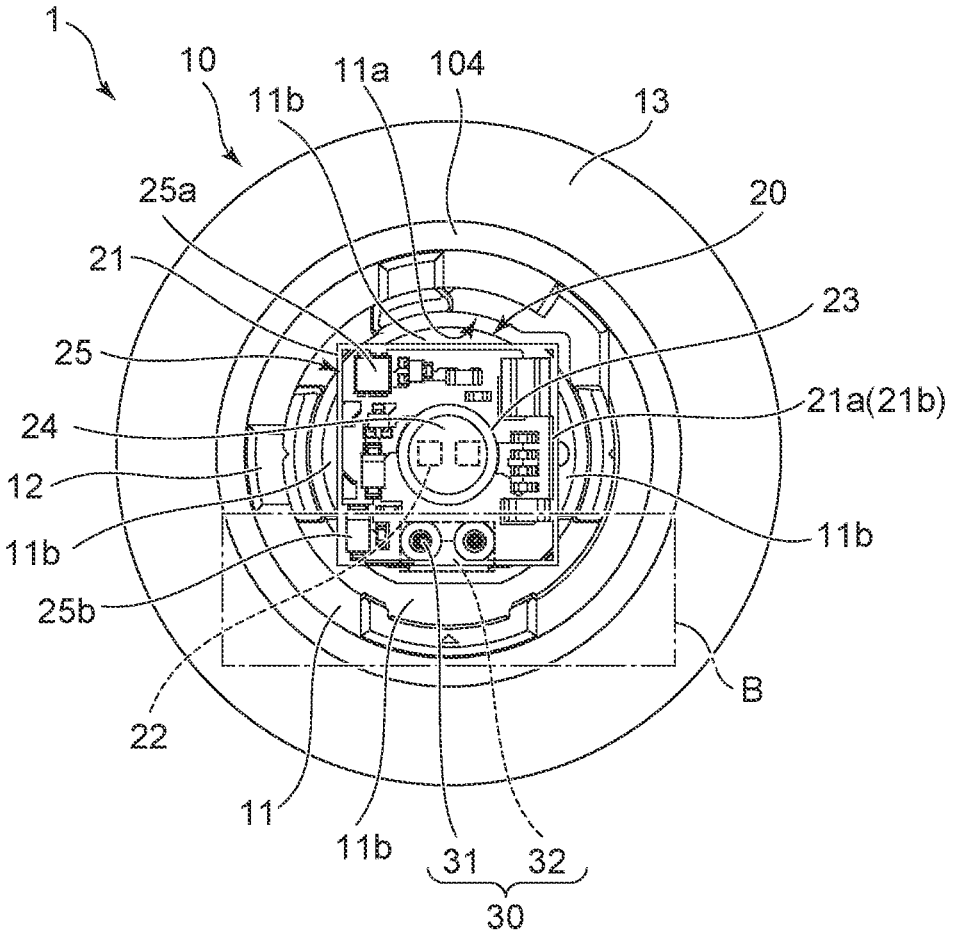
FIG. 2 is a schematic plan view of the vehicle luminaire in FIG. 1 as viewed from a direction A.

FIG. 2 is a schematic plan view of the vehicle luminaire 1 in FIG. 1 as viewed from a direction A.

The direction A is a direction along a central axis 1*a* of the vehicle luminaire 1.

As illustrated in FIGS. 1 and 2, the vehicle luminaire 1 is provided with, for example, a socket 10, a light-emitting module 20, and a power-supply unit 30.

The socket 10 includes, for example, a mounting portion 11, bayonets 12, a flange 13, thermal radiation fins 14, and a connector holder 15.

The mounting portion 11 is provided on a surface of the flange 13 on a side opposite to a side on which the thermal radiation fins 14 are provided. An outer shape of the mounting portion 11 can be a columnar shape. The outer shape of the mounting portion 11 is, for example, a cylindrical shape. The mounting portion 11 has, for example, a recess 11*a* (corresponding to an example of a first recess) that opens on an end of the mounting portion 11 on a side opposite to a flange 13 side. In the case, an inner diameter of the recess 11*a* (a length in a direction orthogonal to the central axis 1*a* of the vehicle luminaire 1) can be set to 10 mm or more and 20 mm or less.

The bayonet 12 is provided, for example, on an outer surface of the mounting portion 11. The bayonet 12 projects toward an outside of the vehicle luminaire 1. The bayonet 12 faces the flange 13. A plurality of the bayonets 12 can be provided. The bayonets 12 are used when the vehicle luminaire 1 is attached to, for example, a housing 101 of a vehicle lamp 100 described later. The bayonets 12 can be used for twist lock.

The flange 13 is provided on a side of the mounting portion 11 opposite to a side on which the recess 11*a* opens. The flange 13 has, for example, a plate shape. The flange 13 has, for example, a disk shape. An outer surface of the flange 13 is located more outside the vehicle luminaire 1 than an outer surface of the bayonet 12.

The thermal radiation fins 14 are provided on a side of the flange 13 opposite to a mounting portion 11 side. At least one thermal radiation fin 14 can be provided. For example, the socket 10 illustrated in FIG. 1 is provided with a plurality of thermal radiation fins 14. The plurality of thermal radiation fins 14 can be provided adjacently in a predetermined direction. The thermal radiation fins 14 illustrated in FIG. 1 have a columnar shape.

The connector holder 15 is provided on a side of the flange 13 opposite to the mounting portion 11 side. The connector holder 15 can be provided adjacently to the thermal radiation fin 14. The connector holder 15 can be provided near a peripheral edge of the flange 13. The connector holder 15 has a tubular shape, and a connector 105 including a sealing member 105*a* is inserted inside of the connector holder 15.

The socket 10 has a function of holding the light-emitting module 20 and the power-supply unit 30, and a function of transferring heat generated in the light-emitting module 20 to an outside. Therefore, the socket 10 is preferably made of a material having high thermal conductivity. For example, the socket 10 can be made of a metal such as an aluminum alloy. In the case, the mounting portion 11, the bayonets 12, the flange 13, the thermal radiation fins 14, and the connector holder 15 can be integrally molded by using a die casting method or the like.

In recent years, it is desired that the socket 10 can efficiently radiate the heat generated in the light-emitting module 20 and is lightweight. Therefore, the socket 10 is preferably made of a high thermal conductive resin. The high thermal conductive resin includes, for example, a resin and a filler made of an inorganic material. The high thermal conductive resin is, for example, a combination of a resin such as polyethylene terephthalate (PET) or nylon and a filler using carbon, aluminum oxide or the like.

If the socket 10 contains the high thermal conductive resin and is integrally molded with the mounting portion 11, the bayonets 12, the flange 13, the thermal radiation fins 14, and the connector holder 15, the heat generated in the light-emitting module 20 can be efficiently radiated. A weight of the socket 10 can be reduced. In the case, the mounting portion 11, the bayonets 12, the flange 13, the thermal radiation fins 14, and the connector holder 15 can be integrally molded by using an injection molding method or the like. The socket 10 and the power-supply unit 30 can be integrally molded by using an insert molding method or the like.

For example, materials of the mounting portion 11 and the bayonets 12 may be different from materials of the flange 13, the thermal radiation fins 14, and the connector holder 15. For example, the mounting portion 11 and the bayonets 12 which are made of the high thermal conductive resin can be joined to the flange 13, the thermal radiation fins 14, and the connector holder 15 which are made of metal.

The light-emitting module 20 is provided inside the recess 11*a* of the mounting portion 11.

The light-emitting module 20 includes, for example, a board 21, a light-emitting element 22, a frame 23, a sealing portion 24, and an element 25.

The board 21 is adhered to, for example, a bottom surface of the recess 11*a*. In the case, an adhesive having high thermal conductivity may be preferably used. For example, the adhesive can be an adhesive mixed with a filler made of an inorganic material. The thermal conductivity of the adhesive is, for example, 0.5 W/(m·K) or more and 10 W/(m·K) or less.

The board 21 has, for example, a plate shape. A planar shape of the board 21 is, for example, a quadrilateral shape. The board 21 can be made of, for example, an inorganic material such as ceramics (for example, aluminum oxide or aluminum nitride), an organic material such as paper phenol or glass epoxy, or the like. The board 21 may be a metal core board or the like in which a surface of a metal plate is coated with an insulating material. When a heat generation amount of the light-emitting element 22 is large, it is preferable to form the board 21 using a material having high thermal conductivity from a viewpoint of thermal radiation. Examples of the material having the high thermal conductivity include ceramics such as aluminum oxide and aluminum nitride, a high thermal conductivity resin, and a metal core board. The board 21 may have a single-layer structure or a multi-layer structure.

A wiring pattern 21*a* is provided on a surface of the board 21. The wiring pattern 21*a* is made of, for example, a material containing silver as a main component, a material containing copper as a main component, or the like.

A covering portion 21*b* can also be provided on the surface of the board 21, and the covering portion 21*b* covers the wiring pattern 21*a*, a film-shaped resistor described later, and the like. The covering portion 21*b* can include, for example, glass or a thermosetting resin.

The light-emitting element 22 is provided on the board 21 (on an opposite side from the socket 10 side). The light-emitting element 22 is electrically connected to the wiring pattern 21*a*. At least one light-emitting element 22 can be provided. When a plurality of light-emitting elements 22 are provided, the plurality of light-emitting elements 22 can be connected in series with one another.

The light-emitting element 22 may be, for example, a light-emitting diode, an organic light-emitting diode, a laser diode, or the like.

The light-emitting element 22 can be, for example, a chip-shaped light-emitting element. If the chip-shaped light-emitting element 22 is used, a region on which the light-emitting element 22 is provided can be reduced, so that a size of the board 21 can be reduced and a size of an outer diameter of the mounting portion 11 can be reduced accordingly. The chip-shaped light-emitting element 22 can be mounted on the wiring pattern 21*a* by a chip on board (COB). The chip-shaped light-emitting element 22 can be, for example, an upper electrode type light-emitting element, an upper and lower electrode type light-emitting element, a flip chip type light-emitting element, or the like. An electrode of the upper electrode type light-emitting element or an upper electrode of the upper and lower electrode type light-emitting element can be electrically connected to the wiring pattern 21*a* by a wiring. In the case, the wiring can connect the electrode and the wiring pattern 21*a* by, for example, a wire bonding method. The flip chip type light-emitting element 22 can be directly mounted on the wiring pattern 21*a*.

The light-emitting element 22 may be, for example, a surface mount type light-emitting element or a bullet type light-emitting element including a lead wire. In the case, considering reduction in size of the light-emitting module 20 and in size of the vehicle luminaire 1, it is preferable to use the chip-shaped light-emitting element. On the other hand, if the surface mount type light-emitting element or the bullet type light-emitting element is used, the frame 23, the sealing portion 24, and the like can be omitted.

The number, a size, an arrangement, and the like of the light-emitting element 22 are not limited to those illustrated above, and can be appropriately changed according to the size, a use, and the like of the vehicle luminaire 1.

The frame 23 is provided on the board 21. The frame 23 has a frame shape and is adhered to the board 21. The frame 23 surrounds the light-emitting element 22. The frame 23 is made of, for example, a resin. The resin can be, for example, a thermoplastic resin such as polybutylene terephthalate (PBT), polycarbonate (PC), PET, nylon, polypropylene (PP), polyethylene (PE), polystyrene (PS), and the like.

The frame 23 can have a function of defining a forming range of the sealing portion 24 and a function of a reflector.

Therefore, the frame 23 may contain titanium oxide particles or the like, or may contain a white resin, in order to improve reflectance of the frame 23.

The sealing portion 24 is provided inside the frame 23. The sealing portion 24 is provided so as to cover a region surrounded by the frame 23. The sealing portion 24 is provided so as to cover the light-emitting element 22. The sealing portion 24 contains a translucent resin. The sealing portion 24 is formed, for example, by filling an inside of the frame 23 with a resin. The filling of the resin is performed using, for example, a dispenser or the like. The filled resin is, for example, a silicone resin.

The sealing portion 24 can contain a phosphor. The phosphor may be, for example, a yttrium-aluminum-garnet-based (YAG-based) phosphor or the like. However, the type of the phosphor can be appropriately changed according to a use of the vehicle luminaire 1 so as to obtain a predetermined emission color.

The element 25 can be a passive element or an active element used for forming a light-emitting circuit including the light-emitting element 22. The element 25 is provided, for example, around the frame 23 and is electrically connected to the wiring pattern 21*a*. At least one element 25 can be provided.

The element 25 can include, for example, a resistor 25*a*, a control element 25*b*, or the like.

However, the type of the element 25 is not limited to those illustrated above, and can be appropriately changed according to a configuration of the light-emitting circuit including the light-emitting element 22. For example, in addition to those described above, the element 25 may be a capacitor, a positive characteristic thermistor, a negative characteristic thermistor, an inductor, a surge absorber, a varistor, a transistor such as an FET or a bipolar transistor, an integrated circuit, an arithmetic element, or the like.

The resistor 25*a* is provided on the board 21. The resistor 25*a* is electrically connected to the wiring pattern 21*a*. The resistor 25*a* can be, for example, a surface mount type resistor, a resistor (metal oxide film resistor) including a lead wire, a film-shaped resistor formed by using a screen printing method, or the like. The resistor 25*a* illustrated in FIG. 1 is a surface mount type resistor.

A material of the film-shaped resistor is, for example, ruthenium oxide ($RuO_2$). The film-shaped resistor is formed using, for example, a screen printing method and a firing method. If the resistor 25*a* is a film-shaped resistor, a contact area between the resistor 25*a* and the board 21 can be increased, so that thermal radiation can be improved. A plurality of resistors 25*a* can be formed at one time. Therefore, productivity can be improved. A variation in resistance values among the plurality of resistors 25*a* can be controlled.

On the other hand, when the resistor 25*a* is a surface mount type resistors or a resistor including a lead wire, the manufacturing process can be simplified.

Here, since forward voltage characteristics of the light-emitting element 22 vary, when an applied voltage between an anode terminal and a ground terminal of the light-emitting circuit is constant, brightness (luminous flux, luminance, luminous intensity, and illuminance) of light emitted from the light-emitting element 22 varies. Therefore, a value of a current flowing through the light-emitting element 22 is set to a predetermined range by the resistor 25*a* connected in series to the light-emitting element 22 in order to make the brightness of the light emitted from the light-emitting element 22 fall within a predetermined range. In this case, by changing a resistance value of the resistor 25*a*, the value of the current flowing through the light-emitting element 22 is set to the predetermined range.

When the resistor 25*a* is a surface mount type resistor or a resistor including a lead wire, the resistor 25*a* having an appropriate resistance value is selected according to the forward voltage characteristics of the light-emitting element 22. When the resistor 25*a* is a film-shaped resistor, the resistance value can be increased if a part of the resistor 25*a* is removed. For example, if the film-shaped resistor is irradiated with a laser beam, a part of the film-shaped resistor can be easily removed. The number, size, and the like of the resistor 25*a* are not limited to those illustrated above, and can be appropriately changed according to the number, a specification, and the like of the light-emitting element 22.

The control element 25*b* is provided on the board 21. The control element 25*b* is electrically connected to the wiring pattern 21*a*. The control element 25*b* is provided, for example, to prevent a reverse voltage from being applied to the light-emitting element 22 and to prevent pulse noise from a reverse direction from being applied to the light-emitting element 22. The control element 25*b* is, for example, a surface mount type diode, a diode including a lead wire, or the like. The control element 25*b* illustrated in FIG. 1 is a surface mount type diode.

In the above, a case where the element 25 is provided on a surface of the board 21 on a side opposite to the socket 10 side is illustrated, but the element 25 can be provided on at least one of both sides of the board 21.

If necessary, an optical element can be provided on the sealing portion 24. The optical element is, for example, a convex lens, a concave lens, a light guide body, or the like.

The power-supply unit 30 includes, for example, a plurality of power-supply terminals 31 and a holding unit 32.

The power-supply terminal 31 can be a rod-shaped body. One end of the power-supply terminal 31 protrudes from the bottom surface of the recess 11*a*. The power-supply terminals 31 are provided, for example, adjacently in a predetermined direction. One end of the power-supply terminal 31 is soldered to the wiring pattern 21*a* provided on the board 21. The other end of the power-supply terminals 31 is exposed inside a hole of the connector holder 15. The connector 105 is fitted to the power-supply terminal 31 exposed inside the hole of the connector holder 15. The power-supply terminal 31 is made of, for example, a metal such as a copper alloy. A shape, an arrangement, a material, and the like of the power-supply terminal 31 are not limited to those illustrated above, and can be appropriately changed.

As described above, the socket 10 is preferably made of a material having high thermal conductivity. However, the material having high thermal conductivity may be electrically conductive. For example, a metal such as an aluminum alloy or a high thermal conductive resin including a filler made of carbon are electrically conductive. Therefore, the holding unit 32 is provided to insulate the power-supply terminals 31 from the socket 10 that is electrically conductive. The holding unit 32 also has a function of holding the power-supply terminals 31. When the socket 10 is made of a high thermal conductive resin (for example, a high thermal conductive resin including a filler made of aluminum oxide) having an insulating property, the holding unit 32 can be omitted. In the case, the socket 10 holds the power-supply terminals 31. The holding unit 32 is made of, for example, an insulating resin. The holding unit 32 can be press-fitted into a hole provided in the socket 10 or adhered to an inner wall of the hole, for example.

A heat transfer unit can be provided between the light-emitting module 20 (board 21) and the socket 10. For example, the heat transfer unit can be adhered to the bottom surface of the recess 11*a* using an adhesive having high thermal conductivity, attached to the bottom surface of the recess 11*a* via a layer containing heat conductive grease (thermal radiation grease), or embedded in the bottom surface of the recess 11*a* using an insert molding method.

For example, the heat transfer unit has a plate shape and is made of a material having high thermal conductivity such as an aluminum alloy. When the socket 10 is made of a metal or heat generated in the light-emitting module 20 is small, the heat transfer unit can be omitted.

Here, the vehicle luminaire 1 may be provided outside a vehicle interior. For example, the vehicle luminaire 1 used for a front combination light, a rear combination light, or the like is provided outside the vehicle interior. The vehicle luminaire 1 provided outside the vehicle interior is required to have high reliability so as to be able to withstand a severe use environment such as a temperature change in the environment, thermal interference from other parts such as an engine, and vibration and shock associated with running.

In the case, for example, a temperature of the socket 10 changes as the light-emitting element 22 is turned on and off. The temperature of the socket 10 may change due to the temperature change in the environment. When the vehicle luminaire 1 is placed in a humid environment and the temperature of the socket 10 changes, water may adhere to the socket 10 due to dew condensation. As described above, the light-emitting module 20 is provided inside the recess 11*a* of the socket 10 (mounting portion 11). Therefore, when the dew condensation occurs, water may adhere to the board 21, the light-emitting element 22, the element 25, the wiring pattern 21*a*, and the like. If the water adheres to these components, a short circuit and ion migration may occur.

Therefore, the mounting portion 11 of the socket 10 is provided with a recess 11*b* (corresponding to an example of the second recess) that captures the water.

For example, the mounting portion 11 has at least one recess 11*b* that opens on the bottom surface of the recess 11*a*.

As illustrated in FIG. 2, when viewed from a direction along the central axis 1*a* of the vehicle luminaire 1 (direction A in FIG. 1), the recess 11*b* can be provided between a side of the board 21 and an inner wall of the recess 11*a* that faces the side. The recess 11*b* may be provided with respect to each of a plurality of sides of the board 21, or may be provided with respect to any of the plurality of sides of the board 21. At least one recess 11*b* can be provided with respect to one side of the board 21. In the case of the socket 10 illustrated in FIG. 2, one recess 11*b* is provided with respect to each of four sides of the board 21.

When the vehicle luminaire 1 is attached to the housing 101 of the vehicle lamp 100 described later, it is preferable that the recess 11*a* is located on a lower side of the board 21 in a gravity direction.

For example, when the vehicle luminaire 1 is provided on a roof of a vehicle body or the like, the central axis 1*a* of the vehicle luminaire 1 is substantially vertical. In such a case, the recess 11*b* may be located around the board 21. The water generated inside the recess 11*a* due to the dew condensation is guided, by gravity, to an inside of the recess 11*b* located on the lower side of the board 21 in the gravity direction. Therefore, the water can be prevented from adhering to the board 21, the light-emitting element 22, the element 25, the wiring pattern 21*a*, and the like.

For example, when the vehicle luminaire 1 is used for the front combination light, the rear combination light, or the like, the central axis 1*a* of the vehicle luminaire 1 is substantially horizontal. In such a case, at least one recess 11*b* may be located on the lower side of the board 21 in the gravity direction. The water generated inside the recess 11*a* due to the dew condensation is guided, by the gravity, to an inside of the recess 11*b* located on the lower side of the board 21 in the gravity direction. Therefore, the water can be prevented from adhering to the board 21, the light-emitting element 22, the element 25, the wiring pattern 21*a*, and the like.

As described above, since the water generated by the dew condensation can be captured if the recess 11*b* is provided around the board 21, an occurrence of the short circuit, the ion migration, or the like in the wiring pattern 21*a* or the like can be reduced. That is, an occurrence of functional impairment due to the dew condensation can be reduced.

Figure 3:
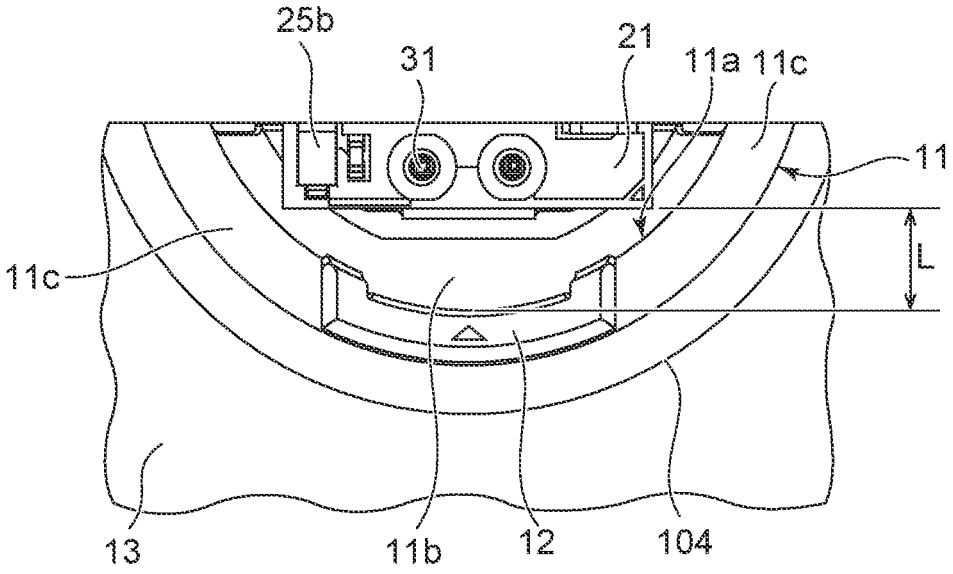
FIG. 3 is a schematic enlarged plan view illustrating a recess 11*b*.

FIG. 3 is a schematic enlarged plan view illustrating the recess 11*b*.

FIG. 3 is a schematic enlarged view of a part B in FIG. 2. As illustrated in FIG. 3, when viewed from a direction along the central axis 1*a* of the vehicle luminaire 1, a distance L (mm) between a side of the board 21 and an inner wall of the recess 11*b* that faces the side is preferably 1 mm or more. In this way, the water can be easily captured. Therefore, the occurrence of the functional impairment due to the dew condensation can be effectively reduced.

A depth of the recess 11*b* (a distance between the bottom surface of the recess 11*a* and a bottom surface of the recess 11*b*) is preferably 1 mm or more. In this way, the captured water can be prevented from overflowing. Therefore, the occurrence of the functional impairment due to the dew condensation can be effectively reduced.

As illustrated in FIG. 1, a notch 11*c* that penetrates between the outer surface of the mounting portion 11 and the inner wall of the recess 11*a* (an inner surface of the mounting portion 11) can be provided. At least one notch 11*c* can be provided. For example, as illustrated in FIG. 1, when viewed from the direction along the central axis 1*a* of the vehicle luminaire 1, the notch 11*c* can be provided between the bayonets 12 adjacent to each other. If the notch 11*c* is provided, even if the water is generated inside the recess 11*a* due to the dew condensation, the generated water can be discharged to an outside of the socket 10 through the notch 11*c*. Therefore, the occurrence of the functional impairment due to the dew condensation can be reduced.

As will be described later, a portion of the mounting portion 11 provided with the bayonets 12 is provided inside the housing 101 of the vehicle lamp 100, and the flange 13, the thermal radiation fins 14, and the connector holder 15 are provided outside the housing 101. In the case, if the mounting portion 11, the bayonets 12, the flange 13, the thermal radiation fins 14, and the connector holder 15 are integrally molded using the same material, the thermal conductivity of the mounting portion 11 and the bayonets 12 are the same as the thermal conductivity of the flange 13, the thermal radiation fins 14, and the connector holder 15. Therefore, a difference between a temperature of a portion of the socket 10 provided inside the housing 101 and a temperature of a portion of the socket 10 provided outside the housing 101 can be reduced. Therefore, the occurrence of the dew condensation can be reduced.

A material of the portion of the socket 10 provided inside the housing 101 may be different from a material of the portion of the socket 10 provided outside the housing 101. For example, as described above, the materials of the mounting portion 11 and the bayonets 12 may be different from the materials of the flange 13, the thermal radiation fins 14, and the connector holder 15. In such a case, a difference between the thermal conductivity of the mounting portion 11 and the bayonets 12 and the thermal conductivity of the flange 13, the thermal radiation fins 14, and the connector holder 15 is preferably 10 W/(m·K) or less. In this way, a difference between the temperature of the portion of the socket 10 provided inside the housing 101 and the temperature of the portion of the socket 10 provided outside the housing 101 can be reduced. Therefore, the occurrence of the dew condensation can be reduced.

A gap in the wiring pattern 21*a* provided on the surface of the board 21 is preferably 0.2 mm or more. In this way, even if the water adheres to the wiring pattern 21*a*, the occurrence of the short circuit, the ion migration, and the like can be reduced.

If the covering portion 21*b* that covers the wiring pattern 21*a*, the film-shaped resistor described later, and the like is provided, even if the water is generated due to the dew condensation, water can be prevented from adhering to the wiring pattern 21*a*, the film-shaped resistor, and the like.

Vehicle Lamp

Next, the vehicle lamp 100 will be illustrated.

In the following, a case where the vehicle lamp 100 is, for example, the front combination light provided in the automobile will be described. However, the vehicle lamp 100 is not limited to the front combination light provided in the automobile. The vehicle lamp 100 may be a vehicle lamp provided in the automobile, the railroad vehicle, or the like.

Figure 4:
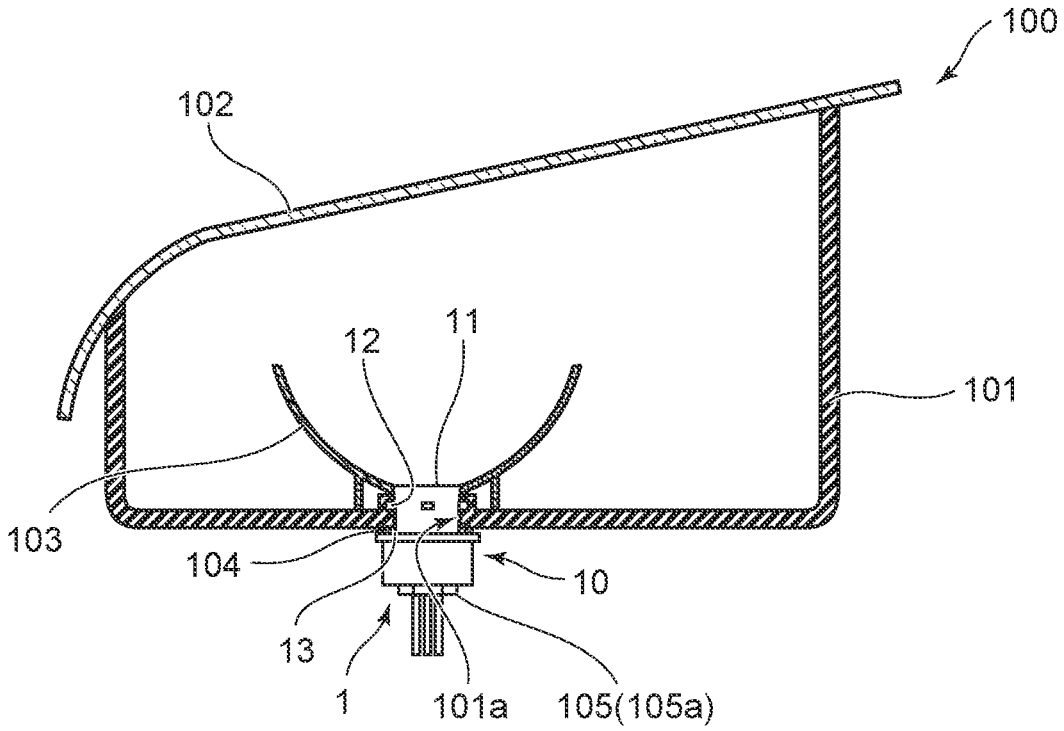
FIG. 4 is a schematic partial cross-sectional view illustrating a vehicle lamp.

FIG. 4 is a schematic partial cross-sectional view illustrating the vehicle lamp 100.

As illustrated in FIG. 4, the vehicle lamp 100 includes, for example, the vehicle luminaire 1, the housing 101, a cover 102, an optical element 103, a sealing member 104, and the connector 105.

The vehicle luminaire 1 is attached to the housing 101. The housing 101 holds the mounting portion 11. The housing 101 has a box shape with one end side open. The housing 101 is made of, for example, a resin that does not transmit light. A bottom surface of the housing 101 is provided with a mounting hole 101*a* into which the portion of the mounting portion 11 provided with the bayonets 12 is inserted. A recess for inserting of the bayonet 12 provided on the mounting portion 11 is provided on a peripheral edge of the mounting hole 101*a*. Although a case where the mounting hole 101*a* is directly provided in the housing 101 is illustrated, a mounting member having the mounting hole 101*a* may be provided in the housing 101.

When the vehicle luminaire 1 is attached to the vehicle lamp 100, the portion of the mounting portion 11 provided with the bayonets 12 is inserted into the mounting hole 101*a*, and the vehicle luminaire 1 is rotated. Thus, for example, the bayonet 12 is held in a fitting portion provided on the peripheral edge of the mounting hole 101*a*. Such a mounting method is called a twist lock.

The cover 102 is provided so as to close opening of the housing 101. The cover 102 is made of a translucent resin or the like. The cover 102 can also have a function such as a lens.

Light emitted from the vehicle luminaire 1 is incident on the optical element 103. The optical element 103 reflects, diffuses, guides, and collects the light emitted from the vehicle luminaire 1, to form a predetermined light distribution pattern. For example, the optical element 103 illustrated in FIG. 4 is a reflector. In the case, the optical element 103 reflects the light emitted from the vehicle luminaire 1 to form the predetermined light distribution pattern.

The sealing member 104 is provided between the flange 13 and the housing 101. The sealing member 104 has an annular shape and is made of an elastic material such as rubber or silicone resin.

When the vehicle luminaire 1 is attached to the vehicle lamp 100, the sealing member 104 is sandwiched between the flange 13 and the housing 101. Therefore, an internal space of the housing 101 can be sealed by the sealing member 104. The bayonet 12 is pressed against the housing 101 by an elastic force of the sealing member 104. Therefore, the vehicle luminaire 1 can be prevented from being detached from the housing 101.

The connector 105 is fitted to ends of the plurality of power-supply terminals 31 exposed inside the connector holder 15. A power-supply (not shown) or the like is electrically connected to the connector 105. Therefore, the power-supply (not shown) and the light-emitting element 22 can be electrically connected by fitting the connector 105 to the ends of the plurality of power-supply terminals 31.

The connector 105 is provided with the sealing member 105*a*. When the connector 105 including the sealing member 105*a* is inserted into the inside of the connector holder 15, an inside of the connector holder 15 is sealed so as to be watertight.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A vehicle luminaire comprising:

a socket including a mounting portion and a plurality of bayonets provided on an outer surface of the mounting portion; and a light-emitting module provided inside a first recess of the mounting portion which opens on one end of the mounting portion, the light-emitting module including a board, a wiring pattern provided on a surface of the board, and a light-emitting element electrically connected to the wiring pattern, the mounting portion including at least one second recess that opens on a bottom surface of the first recess, and when viewed from a direction along a central axis of the vehicle luminaire, the second recess being provided between a side of the board and an inner wall of the first recess that faces the side.

2. The luminaire according to claim 1, wherein the second recess is provided with respect to each of a plurality of sides of the board.

3. The luminaire according to claim 1, wherein the second recess is provided with respect to any of a plurality of sides of the board.

4. The luminaire according to claim 1, wherein the at least one second recess is provided with respect to one side of the board.

5. The luminaire according to claim 1, wherein
a depth of the second recess is 1 mm or more, and
when viewed from the direction along the central axis of the vehicle luminaire, a distance between the side of the board and the inner wall of the first recess that faces the side is 1 mm or more.

6. The luminaire according to claim 1, wherein
when viewed from the direction along the central axis of the vehicle luminaire, a notch that penetrates between the outer surface of the mounting portion and the inner wall of the first recess is provided between the bayonets adjacent to each other.

7. The luminaire according to claim 6, wherein
at least one notch is provided.

8. The luminaire according to claim 1, wherein
a gap in the wiring pattern is 0.2 mm or more.

9. The luminaire according to claim 8, wherein
the wiring pattern is made of a material containing silver as a main component or a material containing copper as a main component.

10. The luminaire according to claim 1, further comprising:
a covering portion provided on the surface of the board, covering the wiring pattern, and containing glass or a thermosetting resin.

11. The luminaire according to claim 10, wherein
the light-emitting module further includes a film-shaped resistor that is electrically connected to the wiring pattern, and
the covering portion further covers the film-shaped resistor.

12. The luminaire according to claim 1, wherein
the socket further includes
a flange provided on a side of the mounting portion opposite to a side on which the first recess opens, and
a thermal radiation fin provided on a side of the flange opposite to a mounting portion side, and
thermal conductivity of the mounting portion and the plurality of bayonets is the same as thermal conductivity of the flange and the thermal radiation fin, or
a difference between the thermal conductivity of the mounting portion and the plurality of bayonets and the thermal conductivity of the flange and the thermal radiation fin is 10 W/(m·K) or less.

13. The luminaire according to claim 12, wherein
the mounting portion, the plurality of bayonets, the flange, and the thermal radiation fin are integrally molded.

14. The luminaire according to claim 1, wherein
an outer shape of the mounting portion is a cylindrical shape.

15. The luminaire according to claim 1, wherein
a length of the first recess in a direction orthogonal to the central axis of the vehicle luminaire is 10 mm or more and 20 mm or less.

16. The luminaire according to claim 1, wherein
the board is adhered to the bottom surface of the first recess.

17. The luminaire according to claim 16, wherein
an adhesive that adheres the board to the bottom surface of the first recess contains a filler made of an inorganic material.

18. The luminaire according to claim 16, wherein
thermal conductivity of an adhesive that adheres the board to the bottom surface of the first recess is 0.5 W/(m·K) or more and 10 W/(m·K) or less.

19. The luminaire according to claim 1, wherein
a planar shape of the board is a quadrilateral shape.

20. A vehicle lamp comprising:
the vehicle luminaire according to claim 1; and
a housing to which the vehicle luminaire is attached.

* * * * *